US010600361B2

(12) United States Patent
Qian et al.

(10) Patent No.: US 10,600,361 B2
(45) Date of Patent: Mar. 24, 2020

(54) DISPLAY PANEL AND THRESHOLD DETECTION METHOD THEREOF

(71) Applicants: Shanghai Tianma AM-OLED Co., Ltd., Shanghai (CN); Tianma Micro-electronics Co., Ltd., Shenzhen (CN)

(72) Inventors: Dong Qian, Shanghai (CN); Zeyuan Chen, Shanghai (CN); Wenhui Zou, Shanghai (CN); Dongxu Xiang, Shanghai (CN); Gang Liu, Shanghai (CN)

(73) Assignees: Shanghai Tianma AM-OLED Co., Ltd., Shanghai (CN); Tianma Micro-electronics Co., Ltd., Shenzhen (CN)

( * ) Notice: Subject to any disclaimer, the term of this patent is extended or adjusted under 35 U.S.C. 154(b) by 342 days.

(21) Appl. No.: 15/353,286

(22) Filed: Nov. 16, 2016

(65) Prior Publication Data

US 2017/0061891 A1 Mar. 2, 2017

(30) Foreign Application Priority Data

Aug. 11, 2016 (CN) ..... 2016 1 0656598

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01); *G09G 2320/0295* (2013.01)

(58) Field of Classification Search
None
See application file for complete search history.

(56) References Cited

U.S. PATENT DOCUMENTS

2014/0022289 A1* 1/2014 Lee ..... G09G 3/3283 345/691
2014/0368489 A1 12/2014 Pak et al.

FOREIGN PATENT DOCUMENTS

| | | | |
|---|---|---|---|
| CN | 101960509 | A | 1/2011 |
| CN | 103165078 | A | 6/2013 |
| CN | 103578411 | A | 2/2014 |
| CN | 103839517 | A | 6/2014 |
| CN | 104778925 | A | 7/2015 |
| CN | 105096820 | A | 11/2015 |
| KR | 20090043301 | A | 5/2009 |

* cited by examiner

*Primary Examiner* — Amare Mengistu
*Assistant Examiner* — Sarvesh J Nadkarni
(74) *Attorney, Agent, or Firm* — Anova Law Group PLLC

(57) ABSTRACT

A display panel and a threshold detection method are provided. The display panel includes a plurality of data signal lines configured to transmit data signals, a plurality of scanning lines configured to transmit driving signals, a plurality of reference voltage signal lines configured to transmit reference voltage signals, and a plurality of pixels enclosed and defined by the mutually insulated data signal lines and scanning lines. A pixel driving circuit is disposed in each pixel, and each pixel driving circuit corresponds to one data signal line and one reference voltage signal line. The pixel driving circuits are arranged in a plurality of rows.

20 Claims, 6 Drawing Sheets

DISPLAY PANEL AND THRESHOLD DETECTION METHOD THEREOF

CROSS-REFERENCES TO RELATED APPLICATIONS

This application claims priority of Chinese Patent Application No. 201610656598.9, filed on Aug. 11, 2016, the entire contents of which are hereby incorporated by reference.

FIELD OF THE INVENTION

The present disclosure generally relates to the field of organic light-emitting display technology and, more particularly, relates to a display panel and a threshold detection method thereof.

BACKGROUND

Because of their fast response time, light weight and thin body, and low power-consumption, etc., organic light-emitting diode (OLED) display devices are considered as next-generation display devices.

Pixels forming an OLED display panel often each includes an OLED and a pixel driving circuit. For example, referring to FIG. 1, FIG. 1 illustrates a schematic view of an existing OLED display panel. A first pixel P1 and a second pixel P2 arranged along a horizontal direction each includes an OLED and a pixel driving circuit that drives the OLED individually. Specifically, the pixel driving circuit in the first pixel P1 is a first pixel driving circuit, and the pixel driving circuit in the second pixel P2 is a second pixel driving circuit. Each pixel driving circuit includes a first transistor ST1, a second transistor ST2, a driving transistor DT, and a storage capacitor Cst. The first transistor ST1, the second transistor ST2, and the driving transistor DT are N-type transistors.

In the first pixel driving circuit, a first scanning line S1 controls the first transistor ST1 to supply data signals carried by a data line DL1 to the driving transistor DT, and a second scanning line S2 controls the second transistor ST2 to supply reference signals carried by a reference line RL1 to the driving transistor DT. Further, the first pixel driving circuit cooperates with the storage capacitor Cst to detect the threshold of the driving transistor DT in the first pixel P1. In the second pixel driving circuit, the first scanning line S1 controls the first transistor ST1 to supply data signals carried by the data line DL2 to the driving transistor DT, and the second scanning line S2 controls the second transistor ST2 to supply reference signals carried by the reference line RL2 to the driving transistor DT. Further, the second pixel driving circuit cooperates with the storage capacitor Cst to detect the threshold of the driving transistor DT in the second pixel P2. In both the first and second pixel driving circuits, the driving transistor DT is electrically connected to a first power supply ELVDD, and the OLED is electrically connected to a second power supply ELVEE.

In the above-described OLED display panel, if each row contains n pixels, then n reference lines and n data lines are needed. That is, at least 2n longitudinal wires are needed, resulting in a relatively complicated wiring, which fails to satisfy the requirements of designing a high PPI display device.

The disclosed display panel and threshold detection method thereof are directed to solve one or more problems set forth above and other problems.

BRIEF SUMMARY OF THE DISCLOSURE

One aspect of the present disclosure provides a display panel. The display panel includes a plurality of data signal lines configured to transmit data signals, a plurality of scanning lines configured to transmit driving signals, a plurality of reference voltage signal lines configured to transmit reference voltage signals, and a plurality of pixels enclosed and defined by the mutually insulated data signal lines and scanning lines. A pixel driving circuit is disposed in each pixel, and each pixel driving circuit corresponds to one data signal line and one reference voltage signal line. The pixel driving circuits are arranged in a plurality of rows, and in one row of the pixel driving circuits, when the reference voltage signal line corresponding to an nth pixel driving circuit is multiplexed as the data signal line corresponding to an (n+1)th pixel driving circuit, the reference voltage line is used to time-sharingly output the reference voltage signal to the nth pixel driving circuit and output the data signal to the (n+1)th pixel driving circuit, where n is an integer. When the data signal line corresponding to the nth pixel driving circuit is multiplexed as the reference voltage signal line corresponding to the (n+1)th pixel driving circuit, the data signal line is used to time-sharingly output the data signal to the nth pixel driving circuit and output the reference voltage signal to the (n+1)th pixel driving circuit.

Another aspect of the present disclosure provides a threshold detection method used in a display panel containing a plurality of data signal lines configured to transmit data signals, a plurality of scanning lines configured to transmit driving signals, a plurality of reference voltage signal lines configured to transmit reference voltage signals, and a plurality of pixels enclosed and defined by the mutually insulated data signal lines and scanning lines. A pixel driving circuit is disposed in each pixel, and each pixel driving circuit corresponds to one data signal line and one reference voltage signal line. The pixel driving circuits are arranged in a plurality of rows, and in one row of the pixel driving circuits, the reference voltage signal line corresponding to an nth pixel driving circuit is multiplexed as the data signal line corresponding to an (n+1)th pixel driving circuit, the reference voltage line is used to output a reference voltage signal during a threshold detection stage of the nth pixel driving circuit, and output a data signal during a threshold detection stage of the (n+1)th pixel driving circuit, where n is an integer. When the data signal line corresponding to the nth pixel driving circuit is multiplexed as the reference voltage signal line corresponding to the (n+1)th pixel driving circuit, the data signal line is used to output a data signal during the threshold detection stage of the nth pixel driving circuit, and output the reference voltage signal during the threshold detection stage of the (n+1)th pixel driving circuit Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

The present disclosure will now be described in more detail hereinafter with reference to exemplary embodiments thereof as shown in the accompanying drawings. It should be understood that the exemplary embodiments disclosed herein are for illustrative purpose only, and are not intended to limit the present disclosure. In addition, it should be noted that, for ease of description, the accompanying drawings merely illustrate a part but not all structures related to the present disclosure.

As discussed above, wiring in existing display panels is relatively complicated, which often fails to satisfy the requirements of designing a high PPI display device.

The present disclosure provides an improved display panel and a threshold detection method thereof. In the disclosed display panel, the number of data lines and reference lines are reduced, leading to a relatively simple wiring structure, which tends to satisfy the requirements of designing high PPI display panels.

Specifically, the disclosed display panel may include a plurality of data signal lines configured to transmit data signals, a plurality of scanning lines configured to transmit driving signals, a plurality of reference voltage signal lines configured to transmit reference voltage signals, and a plurality of pixels enclosed and defined by the mutually insulated data signal lines and scanning lines. Each pixel may include a pixel driving circuit corresponding to one data signal line and one reference voltage signal line.

The plurality of pixel driving circuits may be arranged in a plurality of rows. In one row of the pixel driving circuits, a reference voltage signal line corresponding to an nth pixel driving circuit may be multiplexed as a data signal line corresponding to an (n+1)th pixel driving circuit, where n is a positive integer. Accordingly, the reference voltage signal line corresponding to the nth pixel driving circuit may time-sharingly or multiplexed output a reference voltage signal to the nth pixel driving circuit and output a data signal to the (n+1)th pixel driving circuit.

Optionally, a data signal line corresponding to the nth pixel driving circuit may be multiplexed as a reference voltage signal line corresponding to the (n+1)th pixel driving circuit. Accordingly, the data signal line corresponding to the nth pixel driving circuit may time-sharingly output the reference voltage signal to the nth pixel driving circuit and output the data signal to the (n+1)th pixel driving circuit.

Figure 1:
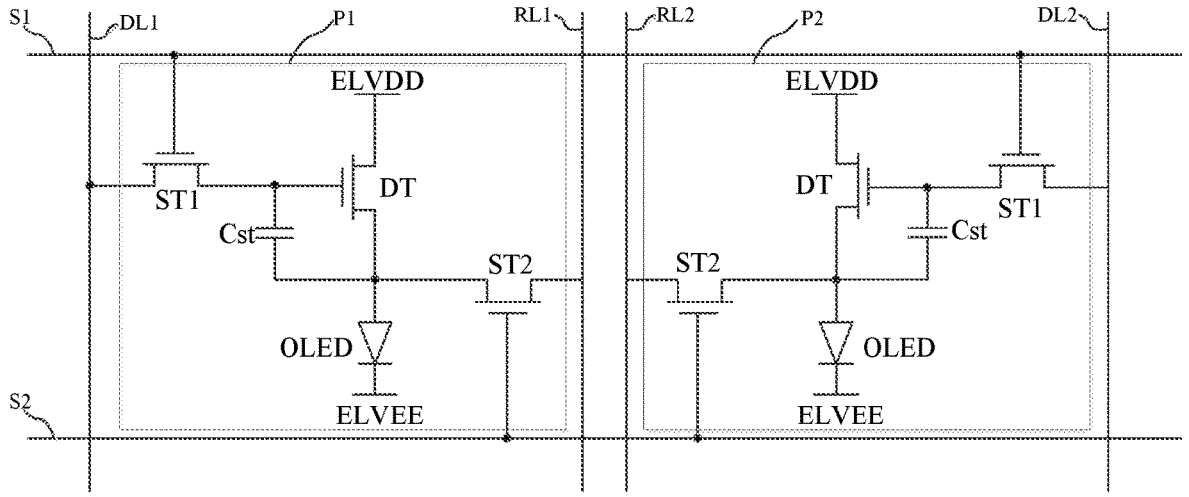
FIG. 1 (Prior Art)
FIG. 1 illustrates an existing display panel.
Figure 2:
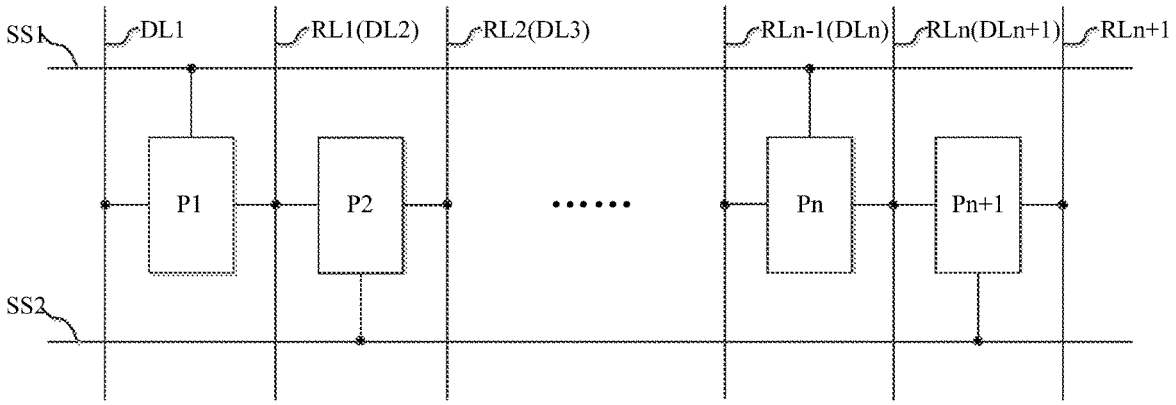
FIG. 2 illustrates an exemplary display panel consistent with disclosed embodiments.

Hereinafter, the present disclosure is illustrated as below with reference to one row of pixel driving circuits in an exemplary display panel. FIG. 2 illustrates an exemplary display panel consistent with disclosed embodiments. As shown in FIG. 2, P1~Pn+1 represent (n+1) pixels in one row of pixel units, where n is a positive integer. The pixels P1~Pn+1 may be disposed in areas enclosed by data signal lines DL1~DLn+1, a scanning line SS1, and a scanning line SS2.

The pixels P1~Pn+1 may each include a pixel driving circuit, known as a 1st~an (n+1)th pixel driving circuit, respectively. That is, the 1st~the (n+1)th pixel driving circuit may be disposed in the pixels P1~Pn+1, respectively. An nth pixel driving circuit may correspond to a data signal line DLn, and a reference voltage signal line RLn. An (n+1)th pixel driving circuit may correspond to a data signal line DLn+1, and a reference voltage signal line RLn+1.

The reference voltage signal line RLn corresponding to the nth pixel driving circuit may be multiplexed as the data signal line DLn+1 corresponding to the (n+1)th pixel driving circuit. That is, the reference number RLn(DLn+1) in FIG. 2 indicates that the reference voltage signal line RLn may be multiplexed as the data signal line DLn+1. The reference voltage signal line RLn and the data signal line DLn+1 may be the same wire configured to time-sharingly supply the reference voltage signal to the nth pixel driving circuit and supply the data signal to the (n+1)th pixel driving circuit.

Those skilled in the art can understand that, the reference voltage signal line RLn corresponding to the nth pixel driving circuit being multiplexed as the data signal line DLn+1 corresponding to the (n+1)th pixel driving circuit may include the following conditions. The reference voltage signal line RL1 corresponding to the 1st pixel driving circuit may be multiplexed as a data signal line DL2 corresponding to a 2nd pixel driving circuit. A reference voltage signal line RL2 corresponding to the 2nd pixel driving circuit may be multiplexed as a data signal line DL3 corresponding to a 3rd pixel driving circuit, and so forth.

Figure 3:
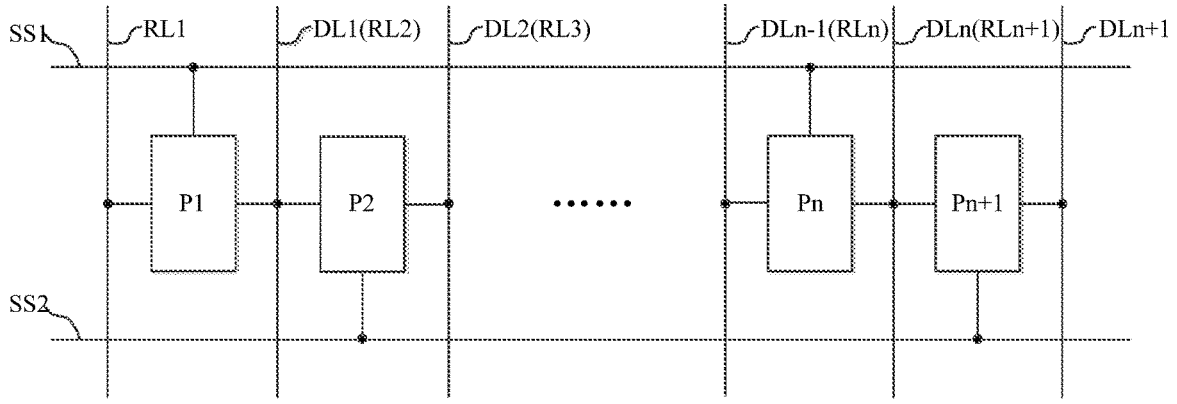
FIG. 3 illustrates another exemplary display panel consistent with disclosed embodiments.

FIG. 3 illustrates another exemplary display panel consistent with the disclosed embodiments. As shown in FIG. 3, P1~Pn+1 represent (n+1) pixels in one row of pixel units, where n is a positive integer. The pixels P1~Pn+1 may be disposed in areas enclosed by the data signal lines DL1~DLn+1, the scanning line SS1, and the scanning line SS2.

The pixels P1~Pn+1 may each include a pixel driving circuit, known as the 1st the (n+1)th pixel driving circuit, respectively. That is, the 1st~the (n+1)th pixel driving circuit may be disposed in the pixels P1~Pn+1, respectively. The nth pixel driving circuit may correspond to the data signal line DLn and the reference voltage signal line RLn. The (n+1)th pixel driving circuit may correspond to the data signal line DLn+1 and the reference voltage signal line RLn+1.

The data signal line DLn corresponding to the nth pixel driving circuit may be multiplexed as the reference voltage signal line RLn+1 corresponding to the (n+1)th pixel driving circuit. That is, the reference number DLn(RLn+1) in FIG. 3 represents that the data signal line DLn may be multiplexed as the reference voltage signal line RLn+1 to time-sharingly supply the data signal to the nth pixel driving circuit and supply the reference voltage signal to the (n+1)th pixel driving circuit.

Those skilled in the art can understand that, the data signal line DLn corresponding to the nth pixel driving circuit being multiplexed as the reference voltage signal line RLn+1 corresponding to the (n+1)th pixel driving circuit may include the following conditions. The data signal line DL1 corresponding to the 1st pixel driving circuit may be multiplexed as the reference voltage signal line RL2 corresponding to the 2nd pixel driving circuit. The data signal line DL2 corresponding to the 2nd pixel driving circuit may be multiplexed as a reference voltage signal line RL3 corresponding to the 3rd pixel driving circuit, and so forth.

The disclosed display panel may, while ensuring the pixel driving circuits in the display panel to realize threshold detection, reduce the number of the data signal lines or the number of the reference voltage signal lines. For example, as shown in FIG. 2 or FIG. 3, for the display panel having n pixel driving circuits in each row, only n+1 longitudinal wires (sum of the number of reference voltage signal lines and the number of data signal lines) are needed, leading to a relatively simple wiring.

Accordingly, the number of the reference voltage signal lines and/or the number of the data signal lines may be reduced. The reduction in the number of data signal lines and the number of reference voltage signal lines may reduce the dimension and the number of driving integrated circuits. Further, the reduction in the number of data signal lines and the number of reference voltage signal lines may also increase the aperture ratio of pixels, which tends to satisfy the requirements of designing high-PPI display panels.

In one embodiment, if the reference voltage signal line corresponding to the nth pixel driving circuit is multiplexed as the data signal line corresponding to the n+1 pixel driving circuit, the first pixel driving circuit in each row of the pixel driving circuits may correspond to an independent data signal line, and the last pixel driving circuit in each row of the pixel driving circuits may correspond to an independent reference voltage signal line.

For example, referring to FIG. 2, in one row of the pixel driving circuits, the first pixel driving circuit (i.e., the 1st pixel driving unit) in the pixel P1 may correspond to the independent data signal line DL1, and the last pixel driving circuit (i.e., the (n+1)th pixel driving unit) in the pixel Pn+1 may correspond to the independent reference voltage signal line RLn+1. In particular, an independent data signal line may refer to a data signal line not being multiplexed as a reference voltage signal line for other pixel driving circuits. Similarly, an independent reference signal line may refer to a reference voltage signal line not being multiplexed as a data signal line for other pixel driving circuits.

In one embodiment, if the data signal line corresponding to the nth pixel driving circuit is multiplexed as the reference voltage signal line corresponding to the (n+1)th pixel driving circuit, the first pixel driving circuit in each row of the pixel driving circuits may correspond to an independent reference voltage signal line, and the last pixel driving circuit in each row of pixel driving circuits may correspond to an independent data signal line.

For example, referring to FIG. 3, in one row of the pixel driving circuits, the first pixel driving circuit (i.e., the 1st pixel driving unit) in the pixel P1 may correspond to the independent reference voltage signal line RL1, and the last pixel driving circuit (i.e., the (n+1)th pixel driving unit) in the pixel Pn+1 may correspond to the independent data signal line DLn+1.

In one embodiment, optionally, in each row of the pixel driving circuits, odd-numbered pixel driving circuits may share the same scanning line, and even-numbered pixel driving circuits may share the same scanning line. That is, two adjacent pixel driving circuits in each row of the pixel driving circuits may share different scanning lines.

Figure 4:
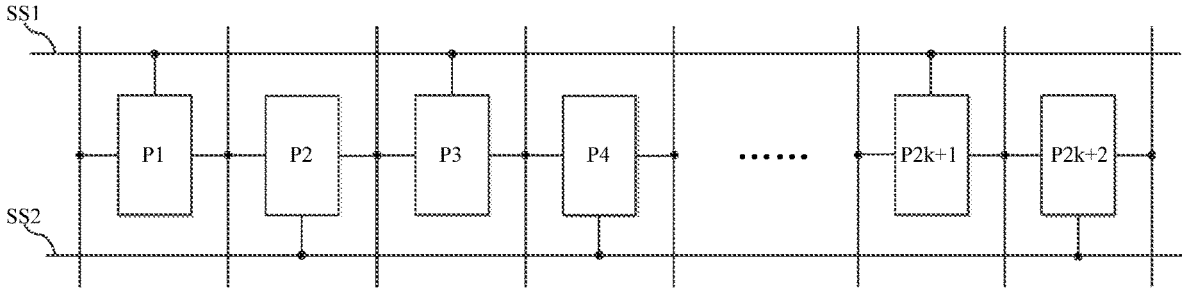
FIG. 4 illustrates another exemplary display panel consistent with disclosed embodiments.

For example, FIG. 4 illustrates another display panel consistent with the disclosed embodiments. As shown in FIG. 4, in one row of pixel driving circuits, the 1st~a (2k+1)th pixel driving circuits may be individually disposed in pixels P1~P2*k*+1, where k is a positive integer. The 1st pixel driving circuit, the 3rd pixel driving circuit, . . . , the (2k+1)th pixel driving circuit may share the scanning line SS1, and the 2nd pixel driving circuit, a 4th pixel driving circuit, . . . , a (2k)th pixel driving circuit may share the scanning line SS2.

Figure 5:
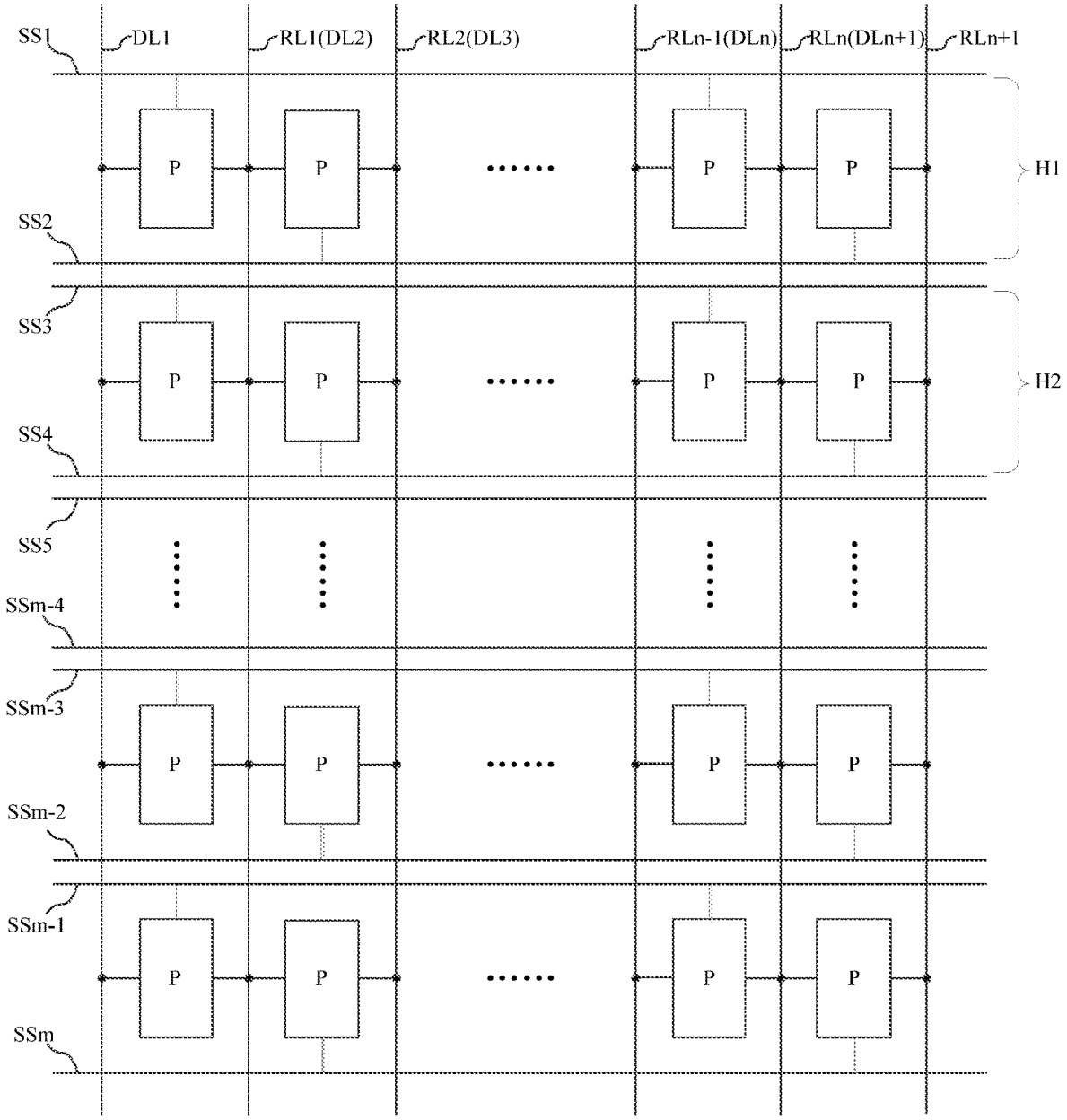
FIG. 5 illustrates another exemplary display panel consistent with disclosed embodiments.

FIG. 5 illustrates another display panel consistent with the disclosed embodiments. As shown in FIG. 5, a plurality of pixels P may be enclosed and defined by mutually insulated data signal lines DL1~DLn+1 and scanning lines SS1~SSm, where m and n are positive integers. Each pixel in the plurality of pixels P may include a pixel driving circuit.

Further, the reference voltage signal line RLn corresponding to the nth pixel driving circuits in each row of the pixel driving circuits may be multiplexed as the data signal line DLn+1 corresponding to the (n+1)th pixel driving circuits. As shown in FIG. 5, each column of pixel driving circuits may share the same data signal line and the same reference voltage signal line. For example, the first column of the pixel driving circuits may share the data signal line DL1 and the reference voltage signal line RL1.

Further, referring to FIG. 5, each row of the pixel driving circuits may share two scanning lines that enclose and define the corresponding row of the pixel driving circuits. For example, a first row of pixel driving circuits H1 in the pixels P enclosed and defined by the scanning line SS1 and the scanning line SS2 may share the scanning line SS1 and the scanning line SS2. A second row of pixel driving circuits H2 in the pixels enclosed and defined by a scanning line SS3 and a scanning line SS4 may share the scanning line SS3 and the scanning line SS4.

One row of pixel driving circuits sharing two scanning lines may specifically refer to odd-numbered pixel driving circuits in this row of pixel driving circuits sharing one scanning line, and even-numbered pixel driving circuits in this row of pixel driving circuits sharing the other scanning line. For example, in the first row of the pixel driving circuits H1, the odd-numbered pixel driving circuit may share the scanning line SS1, and the even-numbered pixel driving circuit may share the scanning line SS2. Optionally, in the first row of the pixel driving circuits H1, the odd-numbered pixel driving circuit may share the scanning line SS2, and the even-numbered pixel driving circuit may share the scanning line SS1.

Figure 6:
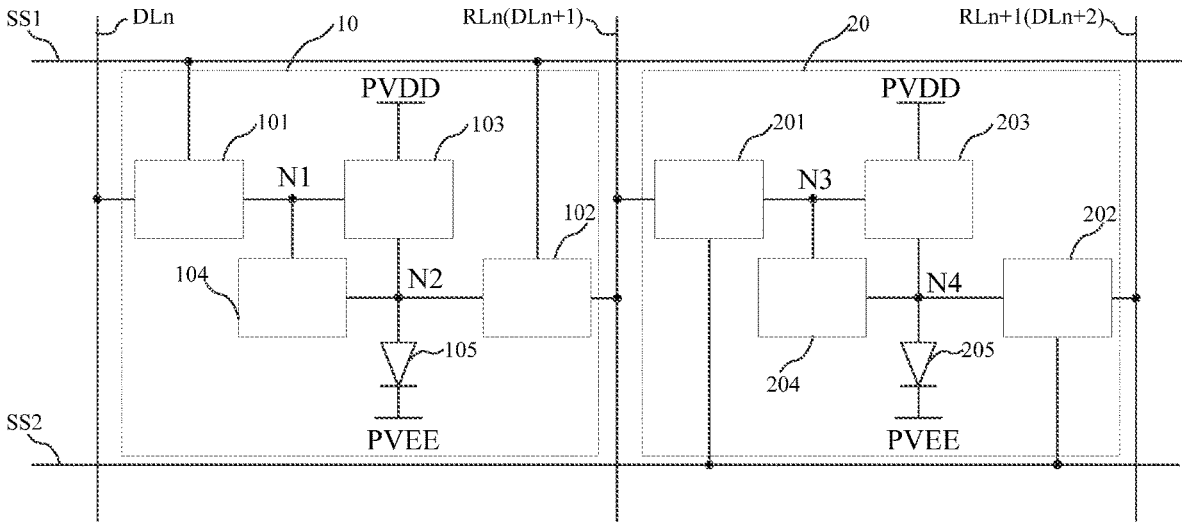
FIG. 6 illustrates a pixel driving circuit in an exemplary display panel consistent with disclosed embodiments.
Figure 7:
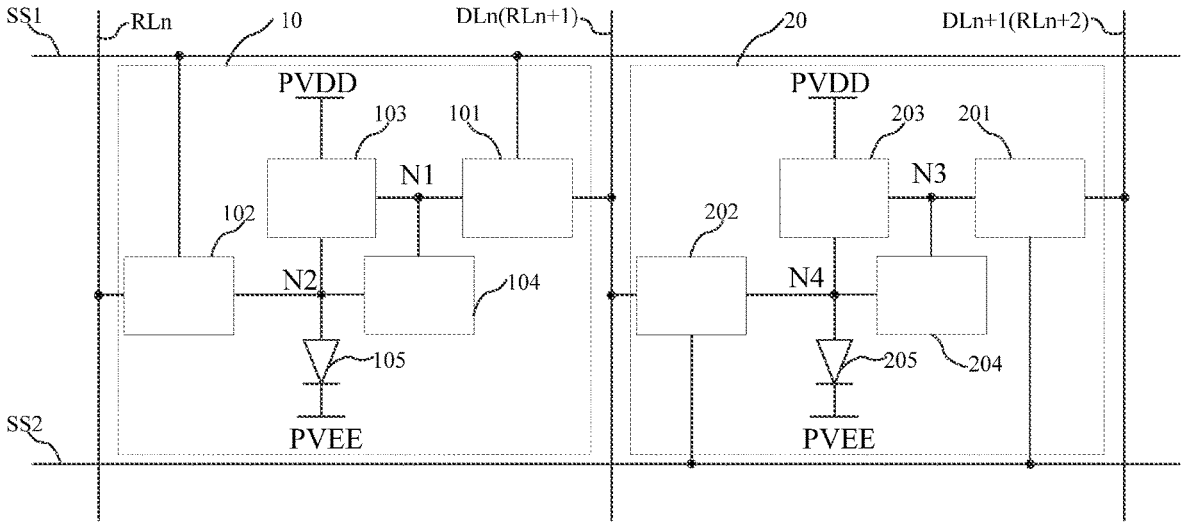
FIG. 7 illustrate another pixel driving circuit in an exemplary display panel consistent with disclosed embodiments.

FIG. 6 illustrates a pixel driving circuit in an exemplary display panel consistent with the disclosed embodiments. FIG. 7 illustrate a pixel driving circuit in another exemplary display panel consistent with the disclosed embodiments. Referring to FIG. 6 and FIG. 7, an nth pixel driving circuit 10 may include a first switch module 101, a second switch module 102, a first driving module 103, a first storage module 104, and a first organic light-emitting unit 105. An (n+1)th pixel driving circuit 20 may include a third switch module 201, a fourth switch module 202, a second driving module 203, a second storage module 204, and a second organic light-emitting unit 205.

A first end of the first switch module 101 may be electrically connected to the nth data signal line DLn, and a second end of the first switch module 101 may be electrically connected to a control end of the first driving module 103. A first end of the first driving module 103 may be electrically connected to a voltage output end of a first power supply PVDD, a second end of the first driving module 103 may be electrically connected to an anode of the first organic light-emitting unit 105, and a cathode of the first organic light-emitting unit 105 may be electrically connected to a voltage output end of a second power supply PVEE.

A first end of the first storage module 104 may be electrically connected to the control end of the first driving module 103, and a second end of the first storage module 104 may be electrically connected to the second end of the first driving module 103. A first end of the second switch module 102 may be electrically connected to the nth reference voltage signal line RLn, and a second end of the second switch module 102 may be electrically connected to the second end of the first driving module 103.

A second end of the third switch module 201 may be electrically connected to a control end of the second driving module 203. A first end of the second driving module 203 may be electrically connected to the voltage output end of the first power supply PVDD, and a second end of the second driving module 203 may be electrically connected to an anode of the second organic light-emitting unit 205. A cathode of the second organic light-emitting unit 205 may be electrically connected to a voltage output end of the second power supply PVEE. Further, a first end of the second storage module 204 may be electrically connected to a control end of the second driving module 203, and a second end of the second storage module 204 may be electrically connected to the second end of the second driving module 203. A second end of the fourth switch module 202 may be electrically connected to the second end of the second driving module 203.

Further, in one embodiment, as shown in FIG. 6, a first end of the third switch unit 201 may be electrically connected to the nth reference voltage signal line RLn, and a first end of the fourth switch module 202 may be electrically connected to the (n+1)th reference voltage signal line RLn+1. In another embodiment, as shown in FIG. 7, the first end of the third switch module 201 may be electrically connected to the (n+1)th data signal line DLn+1, and the first end of the fourth switch unit 202 may be electrically connected to the nth data signal line DLn.

Further, as shown in FIG. 6 and FIG. 7, the control end of the first switch module and the control end of the second switch module in the nth pixel driving circuit 10 (e.g., n is an odd number) may be electrically connected to the first driving line or scanning line SS1. The control end of the third switch module and the control end of the fourth switch module in the (n+1)th pixel driving circuit 20 (e.g., n+1 is an even number) may be electrically connected to the second scanning line SS2.

Figure 8:
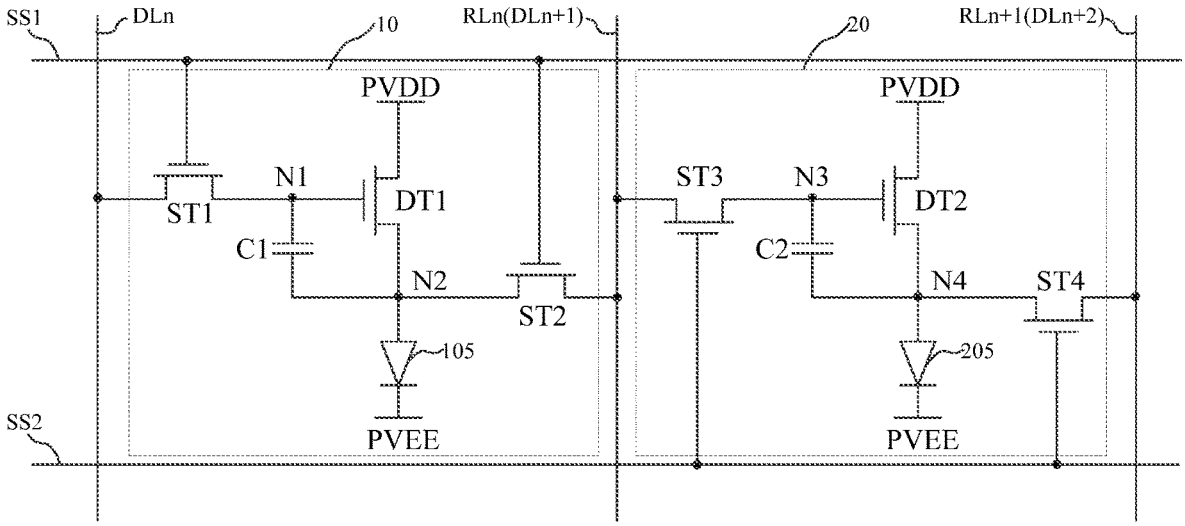
FIG. 8 illustrates a schematic view of an exemplary pixel driving circuit in FIG. 6 consistent with the disclosed embodiments.
Figure 9:
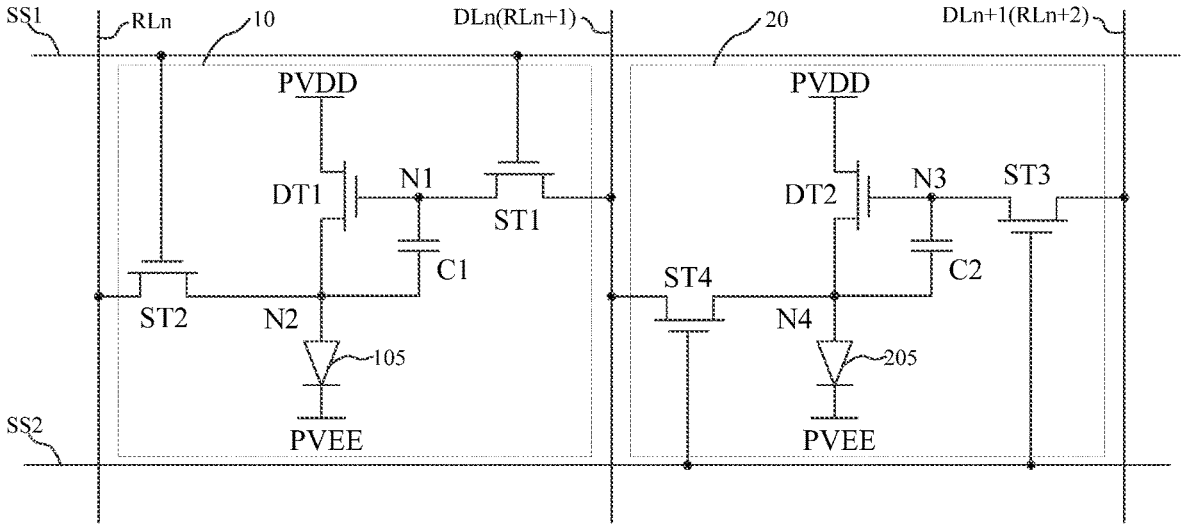
FIG. 9 illustrates a schematic view of an exemplary pixel driving circuit in FIG. 7 consistent with the disclosed embodiments.

FIG. 8 illustrates a specific structure of an exemplary pixel driving circuit in FIG. 6. FIG. 9 illustrates a specific structure of an exemplary pixel driving circuit in FIG. 7. Referring to FIG. 8 and FIG. 9, the first switch module 101 may include a first transistor ST1, the second switch module 102 may include a second transistor ST2, the first driving module 103 may include a first driving transistor DT1, a first storage module 104 may include a first capacitor C1. Further, the third switch module 201 may include a third transistor ST3, the fourth switch unit 202 may include a fourth transistor ST4, the second driving module 203 may include a second driving transistor DT2, and the second storage module 204 may include a second capacitor C2.

Further, as shown in FIG. 8 and FIG. 9, a first electrode of the first transistor ST1 may be electrically connected to the nth data signal line DLn, and a second electrode of the first transistor ST1 may be electrically connected to a gate electrode of the first driving transistor DT1. A drain electrode of the first driving transistor DT1 may be electrically connected to the voltage output end of the first power supply PVDD, the gate electrode of the first driving transistor DT1 may be electrically connected to a first polar plate of the first capacitor C1, and a source electrode of the first driving transistor DT1 may be electrically connected to a second polar plate of the first capacitor C1 and the anode of the first organic light-emitting unit 105. A first electrode of the second transistor ST2 may be electrically connected to the nth reference voltage signal line RLn, and a second electrode of the second transistor ST2 may be electrically connected to the source electrode of the first driving transistor DT1.

A second electrode of the third transistor ST3 may be electrically connected to a gate electrode of the second driving transistor DT2. A drain electrode of the second transistor DT2 may be electrically connected to the voltage output end of the first power supply PVDD, the gate electrode of the second driving transistor DT2 may be electrically connected to a first polar plate of the second capacitor C2, and a source electrode of the second driving transistor DT2 may be electrically connected to a second polar plate of the second capacitor C2 and the anode of the second organic light-emitting unit 205. A second electrode of the fourth transistor ST4 may be electrically connected to the source electrode of the second driving transistor DT2.

The cathode of the first organic light-emitting unit 105 and the cathode of the second organic light-emitting unit 205 may each be electrically connected to the voltage output end of the second power supply PVEE.

Optionally, as shown in FIG. 8, a first electrode of the third transistor ST3 may be electrically connected to the nth reference voltage signal line RLn, and a first electrode of the fourth transistor ST4 may be electrically connected to the (n+1)th reference voltage signal line RLn+1. Optionally, as shown in FIG. 9, the first electrode of the third transistor ST3 may be electrically connected to the (n+1)th data signal line DLn+1, and the first electrode of the fourth transistor ST4 may be electrically connected to the nth data signal line DLn.

In particular, the first driving transistor DT1, the second driving transistor DT2, the first transistor ST1, the second transistor ST2, the third transistor ST3, and the fourth transistor ST4 may all be N-type transistors, or may all be P-type transistors. However, the types of the first driving transistor DT1, the second driving transistor DT2, the first transistor ST1, the second transistor ST2, the third transistor ST3, and the fourth transistor ST4 are for illustrative purpose only, and are not intended to limit the scope of the present disclosure.

The present disclosure also provides a method for driving pixels, which can be implemented by the disclosed display panel. In the disclosed method, a driving sequence of any pixel driving circuit in the display panel may include a threshold detection stage. Optionally, the reference voltage signal line corresponding to the nth pixel driving circuit may output a reference voltage signal during the threshold detection stage of the nth pixel driving circuit and output a data signal during the threshold detection stage of the (n+1)th pixel driving circuit.

Optionally, the data signal line corresponding to the nth pixel driving circuit may output the data signal during the threshold detection stage of the nth pixel driving circuit and output the reference voltage signal during the threshold detection stage of the (n+1)th pixel driving circuit.

Optionally, in each display frame, any pixel driving circuit may perform the threshold detection stage. After performing the threshold detection stage, threshold of driving modules in the pixel driving circuit may be detected. Thus, in a display stage, the data signal after compensation may be driven according to the detected threshold, and the compensated data signal may be time-sharingly outputted to the data signal line and the reference voltage signal line that is multiplexed as the data signal line.

Optionally, in a pre-determined time period before display, all pixel driving circuits may fulfill the threshold detection stage. Specifically, in the pre-determined time period before display, for example, when the display panel is powered up, the threshold detection stage may be fulfilled and the threshold of the driving module in each pixel driving circuit may be detected. The detected threshold of the driving module may be saved in the storage capacitor that is electrically connected to the driving module. The data signal carried by the data signal lines, and the reference voltage signal carried by the reference voltage signal lines may be provided by the pixel driving circuit. During a display stage, the pixel driving circuit may determine the data signal after compensation according to the detected threshold of the driving module, and the compensated data signal may be time-sharingly outputted to the data signal line and the reference voltage signal line that is multiplexed as the data signal line.

Figure 10:
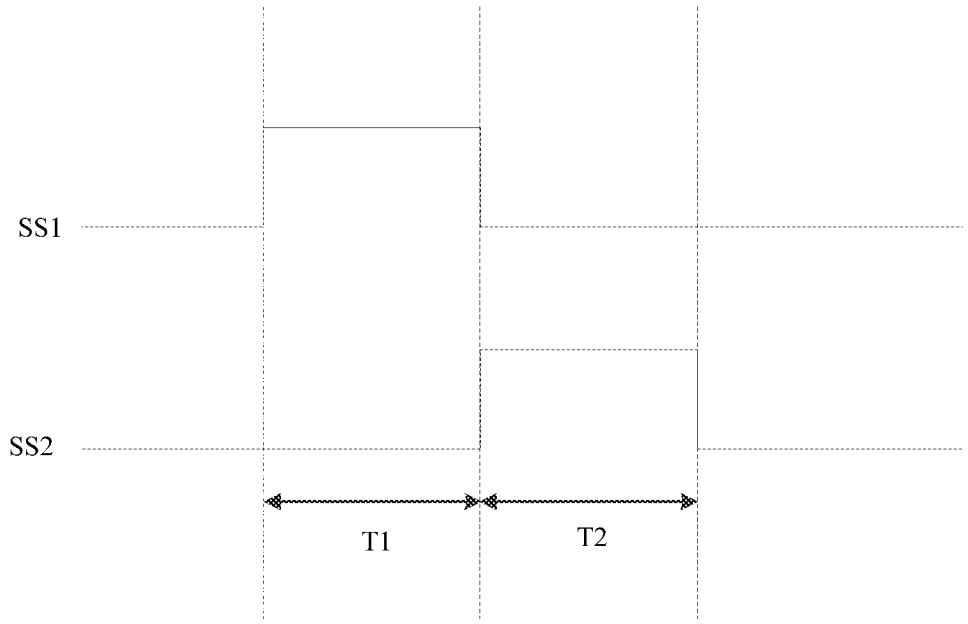
FIG. 10 illustrates a driving sequence of an exemplary display panel consistent with the disclosed embodiments.

FIG. 10 illustrate a driving sequence of an exemplary display panel consistent with the disclosed embodiments. As shown in FIG. 10, a T1 stage refers to a threshold detection stage of the nth pixel driving circuit in one row of the pixel driving circuits in the display panel, and a T2 stage refers to a threshold detection stage of the (n+1)th pixel driving circuit. Hereinafter, the specific operation process of the nth and (n+1)th pixel driving circuits during the threshold detection stage is illustrated with reference to the pixel driving circuits in FIG. 8.

During the T1 stage, a first data signal may be outputted to the first transistor ST1 via the data signal line DLn, and a first reference voltage signal may be outputted to the second transistor ST2 via the reference voltage line RLn. A first voltage signal carried by the first gate line or scanning line SS1 may control the first transistor ST1 and the second transistor ST2 to be turned on, and a second voltage signal carried by the second gate line or scanning line SS2 may control the third transistor ST3 and the fourth transistor ST4 to be turned off. The first transistor ST1 being turned on may transmit the first data signal to the first polar plate of the first capacitor C1, and the second transistor ST2 being turned on may transmit the first reference voltage signal to the second polar plate of the first capacitor C1.

Thus, the first capacitor C1 may be charged until the voltage between the first polar plate and the second polar plate is higher than the threshold voltage of the first driving transistor DT1 to drive the first driving transistor DT1. A current passing the first driving transistor DT1 may be transmitted to the reference voltage signal line RLn via a second node N2, and the voltage carried by the reference voltage signal RLn may continuously increase.

As the voltage of the second node N2 increases, the voltage difference between a first node N1 and the second node N2 may continuously decrease. When the voltage difference between the first node N1 and the second node N2 (i.e., the voltage difference between the first polar plate and the second polar plate of the first capacitor C1) is equal to the threshold voltage of the first driving transistor DT1, the first driving transistor DT1 may be turned off, the voltage of the second node N2 may be saturated, and the voltage of the reference voltage signal line RLn may also be saturated. That is, the voltage of the second node N2 and the voltage of the reference voltage signal line RLn may no longer change. Measurement of the saturation voltage of the reference voltage signal line RLn may be carried out to detect the threshold voltage of the first driving transistor DT1.

During the T2 stage, a second data signal may be outputted to the third transistor ST3 via the reference voltage signal line RLn, and a second reference voltage signal may be outputted to the fourth transistor ST4 via the reference voltage line RLn+1. A first voltage level signal carried by the second scanning line SS2 may control the third transistor ST3 and the fourth transistor ST4 to be turned on, and a second voltage level signal carried by the first scanning line SS1 may control the first transistor ST1 and the second transistor ST2 to be turned off.

The third transistor ST3 being turned on may transmit the second data signal to the first polar plate of the second capacitor C2, and the fourth transistor ST4 being turned on may transmit the second reference voltage signal to the second polar plate of the second capacitor C2. The second capacitor C2 may be charged until the voltage between the first polar plate and the second polar plate is higher than the threshold voltage of the second driving transistor DT2 to drive the second driving transistor DT2.

The current passing the second driving transistor DT2 may be transmitted to the reference voltage signal line RLn+1 via a fourth node N4, and the voltage of the reference voltage signal line RLn+1 may continuously decrease. As the voltage of the fourth node N4 increases, the voltage difference between a third node N3 and the fourth node N4 may continuously decrease. When the voltage difference between the third node N3 and the fourth node N4 (i.e., the voltage difference between the first polar plate and the second polar plate of the second capacitor C2) is equal to the threshold voltage of the second driving transistor DT2, the second driving transistor DT2 may be turned off, the voltage of the fourth node N4 may be saturated, and the voltage of the reference voltage signal line RLn+1 may also be saturated.

That is, the voltage of the fourth node N4 and the voltage of the reference voltage signal line RLn+1 may no longer change. Measurement of the saturation voltage of the reference voltage signal line RLn+1 may be carried out to detect the threshold voltage of the second driving transistor DT2.

Figure 11:
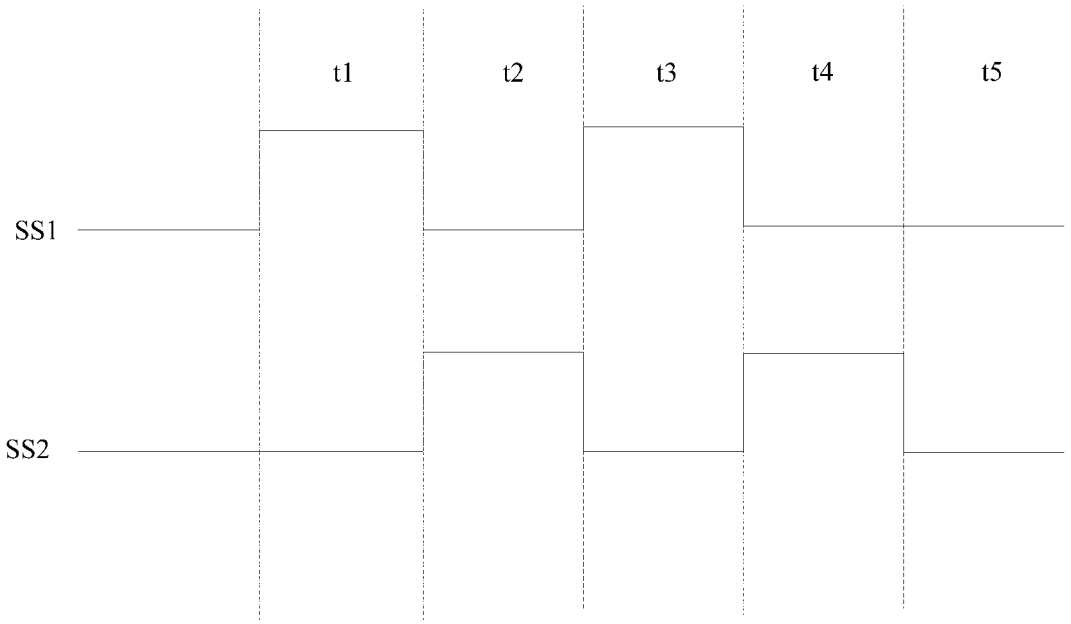
FIG. 11 illustrates another driving sequence of an exemplary display panel consistent with the disclosed embodiments.

FIG. 11 illustrate another driving sequence of an exemplary display panel consistent with the disclosed embodiments. As shown in FIG. 11, a t1 stage refers to a threshold detection stage of the nth pixel driving circuit in one row of the pixel driving circuits in the display panel, a t2 stage refers to a threshold detection stage of the (n+1)th pixel driving circuit, a t3 stage refers to a pre-display stage of the nth pixel driving circuit in one row of the pixel driving circuits in the display panel, a t4 stage refers to a pre-display stage of the (n+1)th pixel driving circuit, and a t5 stage refers to a display stage.

Hereinafter, the specific operation process of the nth and (n+1)th pixel driving circuits during the threshold detection stage is illustrated with reference to the pixel driving circuits in FIG. 8.

During the t1 stage, the first data signal may be outputted to the first transistor ST1 via the data signal line DLn, and the first reference voltage signal may be outputted to the second transistor ST2 via the reference voltage line RLn. The first voltage signal carried by the first scanning line SS1 may control the first transistor ST1 and the second transistor ST2 to be turned on, and a second voltage signal carried by the second scanning line SS2 may control the third transistor ST3 and the fourth transistor ST4 to be turned off. The first transistor ST1 being turned on may transmit the first data signal to the first polar plate of the first capacitor C1, and the second transistor ST2 being turned on may transmit the first reference voltage signal to the second polar plate of the first capacitor C1.

Thus, the first capacitor C1 may be charged until the voltage between the first polar plate and the second polar plate is higher than the threshold voltage of the first driving transistor DT1 to drive the first driving transistor DT1. A current passing the first driving transistor DT1 may be transmitted to the reference voltage signal line RLn via a second node N2, and the voltage carried by the reference voltage signal RLn may continuously increase. As the voltage of the second node N2 increases, the voltage difference between a first node N1 and the second node N2 may continuously decrease.

When the voltage difference between the first node N1 and the second node N2 (i.e., the voltage difference between the first polar plate and the second polar plate of the first capacitor C1) is equal to the threshold voltage of the first driving transistor DT1, the first driving transistor DT1 may be turned off, the voltage of the second node N2 may be saturated, and the voltage of the reference voltage signal line RLn may also be saturated. That is, the voltage of the second node N2 and the voltage of the reference voltage signal line RLn may no longer change. Measurement of the saturation voltage of the reference voltage signal line RLn may be carried out to detect the threshold voltage of the first driving transistor DT1. The detected threshold voltage of the first driving transistor DT1 may be saved in the first capacitor C1 electrically connected to the first driving transistor DT1.

During the t2 stage, the second data signal may be outputted to the third transistor ST3 via the reference voltage signal line RLn, and the second reference voltage signal may be outputted to the fourth transistor ST4 via the reference voltage line RLn+1. The first voltage level signal carried by the second scanning line SS2 may control the third transistor ST3 and the fourth transistor ST4 to be turned on, and the second voltage level signal carried by the first scanning line SS1 may control the first transistor ST1 and the second transistor ST2 to be turned off.

The third transistor ST3 being turned on may transmit the second data signal to the first polar plate of the second capacitor C2, and the fourth transistor ST4 being turned on may transmit the second reference voltage signal to the second polar plate of the second capacitor C2. The second capacitor C2 may be charged until the voltage between the first polar plate and the second polar plate is higher than the threshold voltage of the second driving transistor DT2 to drive the second driving transistor DT2. The current passing the second driving transistor DT2 may be transmitted to the reference voltage signal line RLn+1 via a fourth node N4, and the voltage of the reference voltage signal line RLn+1 may continuously decrease.

As the voltage of the fourth node N4 increases, the voltage difference between a third node N3 and the fourth node N4 may continuously decrease. When the voltage difference between the third node N3 and the fourth node N4 (i.e., the voltage difference between the first polar plate and the second polar plate of the second capacitor C2) is equal to the threshold voltage of the second driving transistor DT2, the second driving transistor DT2 may be turned off, the voltage of the fourth node N4 may be saturated, and the voltage of the reference voltage signal line RLn+1 may also be saturated.

That is, the voltage of the fourth node N4 and the voltage of the reference voltage signal line RLn+1 may no longer change. Measurement of the saturation voltage of the reference voltage signal line RLn+1 may be carried out to detect the threshold voltage of the second driving transistor DT2. The detected threshold voltage of the second driving transistor DT2 may be saved in the second capacitor C2 electrically connected to the first driving transistor DT2.

During the t3 stage, the first voltage signal carried by the first scanning line SS1 may control the first transistor ST1 and the second transistor ST2 to be turned on, and the second voltage signal carried by the second scanning line SS2 may control the third transistor ST3 and the fourth transistor ST4 to be turned off. The voltage of the first node N1 and the voltage of the second node N2 may be configured according to the detected threshold voltage of the first driving transistor DT1 and then saved in the first capacitor C1.

During the t4 stage, the first voltage signal carried by the second scanning line SS2 may control the third transistor ST3 and the second transistor ST4 to be turned on, and the second voltage signal carried by the first scanning line SS1 may control the first transistor ST1 and the second transistor ST2 to be turned off. The voltage of the third node N3 and the voltage of the fourth node N4 may be configured according to the detected threshold voltage of the second driving transistor DT2 and then saved in the second capacitor C2.

During the t5 stage, the detected threshold voltage of the first driving transistor DT1 may be time-sharingly outputted to the data signal line DLn, and the reference voltage signal line RLn multiplexed as the data signal line DLn+1. Meanwhile, the detected threshold voltage of the second driving transistor DT2 may be time-sharingly outputted to data signal line DLn+1, and the reference voltage signal line RLn+1 multiplexed as the data signal line DLn+2.

It should be noted that the above-mentioned first reference voltage signal and the second reference voltage signal may only be used to differentiate the reference voltage signals of two different pixels for ease of description, and are not intended to indicate that the first reference voltage signal is different from the second reference voltage concerning the electrical properties. Similarly, the first data signal and the second data signal may only be used to differentiate the data signals of two different pixels for ease of description. The first data signal and the second data signal may be the same or may be different based on actual requirements.

It should also be noted that the embodiment in FIG. 10 and FIG. 11 are illustrated with reference to a circuit constituting pure N-type transistors as illustrated in FIG. 8. Accordingly, the first voltage signal mentioned in FIG. 10 and FIG. 11 may be a high voltage signal, and the second voltage signal may be a low voltage signal. However, the types of the first voltage level signal and the second voltage level signal are not limited thereto. For example, when the disclosed circuit is a circuit constituting pure P-type transistors, in the corresponding driving method, the first voltage signal may be a low voltage signal, and the second voltage signal may be a high voltage signal.

The above-described operation process may refer to a threshold detection process for a display panel in which the reference voltage signal line of the nth pixel driving circuit is multiplexed as the (n+1)th data signal line. Similarly, the threshold voltage detection process for the display panel in which the reference voltage signal line is multiplexed as the data signal line.

It should be noted that, the above detailed descriptions illustrate merely preferred embodiments of the present disclosure as well as technologies and principles applied herein. Those skilled in the art can understand that the present disclosure is not limited to the specific embodiments described herein, and numerous significant alterations, modifications and alternatives may be devised by those skilled in the art without departing from the spirit and scope of the present disclosure. Thus, although the present disclosure has been illustrated in above-described embodiments in details, the present disclosure is not limited to the above embodiments. Any equivalent or modification thereof, without departing from the spirit and principle of the present invention, falls within the true scope of the present invention, and the scope of the present disclosure is defined by the appended claims.

What is claimed is:

1. A display panel, comprising:

a plurality of data signal lines configured to transmit data signals;

a plurality of scanning lines configured to transmit driving signals, and mutually insulated from the plurality of data signal lines;

a plurality of reference voltage signal lines configured to transmit reference voltage signals; and a plurality of pixels enclosed and defined by the mutually insulated plurality of data signal lines and plurality of scanning lines, wherein a pixel driving circuit is disposed in each pixel, and each pixel driving circuit corresponds to one data signal line and one reference voltage signal line, the pixel driving circuits are arranged in a plurality of rows, and in one row of the pixel driving circuits:

when a same signal line is used as a reference voltage signal line RL(n), corresponding to an nth pixel driving circuit, and as a data signal line DL(n+1), corresponding to an (n+1)th pixel driving circuit, the same signal line is used to time-sharingly output a reference voltage signal to the nth pixel driving circuit and output a data signal to the (n+1)th pixel driving circuit, where n is a positive integer, and each column of the pixel driving circuits share a same data signal line and a same reference voltage signal line.

2. The display panel according to claim 1, wherein:

when the same signal line is used as the reference voltage signal line RL(n) and as the data signal line DL(n+1), a first pixel driving circuit has an independent data signal line, and a last pixel driving circuit has an independent reference voltage signal line.

3. The display panel according to claim 1, wherein:

in each row of the pixel driving circuits, odd-numbered pixel driving circuits share the same scanning line, and even-numbered pixel driving circuits share the same scanning line.

4. The display panel according to claim 1, wherein:

the nth pixel driving circuit includes a first transistor, a second transistor, a first driving transistor, a first storage capacitor, and a first organic light-emitting diode; and the (n+1)th pixel driving circuit includes a third transistor, a fourth transistor, a second driving transistor, a second storage capacitor, and a second organic light-emitting diode.

5. The display panel according to claim 1, wherein:

the nth pixel driving circuit includes a first transistor and a second transistor, the (n+1)th pixel driving circuit includes a third transistor and a fourth transistor, a gate electrode of the first transistor and a gate electrode of the second transistor are electrically connected to one of the plurality of scanning lines, and a gate electrode of the third transistor and a gate electrode of the fourth transistor are electrically connected to another one of the plurality of scanning lines.

6. A display panel, comprising:

a plurality of data signal lines configured to transmit data signals;

a plurality of scanning lines configured to transmit driving signals, and mutually insulated from the plurality of data signal lines;

a plurality of reference voltage signal lines configured to transmit reference voltage signals; and a plurality of pixels enclosed and defined by the mutually insulated plurality of data signal lines and plurality of scanning lines, wherein:

a pixel driving circuit is disposed in each pixel, and each pixel driving circuit corresponds to one data signal line and one reference voltage signal line;

the pixel driving circuits are arranged in a plurality of rows, and in one row of the pixel driving circuits:

when the reference voltage signal line corresponding to an nth pixel driving circuit is multiplexed as the data signal line corresponding to an (n+1)th pixel driving circuit, the reference voltage line is used to time-sharingly output the reference voltage signal to the nth pixel driving circuit and output the data signal to the (n+1)th pixel driving circuit, where n is a positive integer;

the nth pixel driving circuit includes a first transistor, a second transistor, a first driving transistor, a first storage capacitor, and a first organic light-emitting diode;

the (n+1)th pixel driving circuit includes a third transistor, a fourth transistor, a second driving transistor, a second storage capacitor, and a second organic light-emitting diode;

a first end of the first transistor is electrically connected to an nth data signal line, and a second end of the first transistor is electrically connected to a control end of the first driving transistor;

a first end of the first driving transistor is electrically connected to a voltage output end of a first power supply, a second end of the first driving transistor is electrically connected to an anode of the first organic light-emitting diode, and a cathode of the first organic light-emitting diode is electrically connected to a voltage output end of a second power supply;

a first end of the first storage capacitor is electrically connected to the control end of the first driving transistor, and a second end of the first storage transistor is electrically connected to the second end of the first driving transistor;

a first end of the second transistor is electrically connected to the nth reference voltage signal line, and a second end of the second transistor is electrically connected to the second end of the first driving transistor;

a second end of the third transistor is electrically connected to a control end of the second driving transistor;

a first end of the second driving transistor is electrically connected to the voltage output end of the first power supply, a second end of the second driving transistor is electrically connected to an anode of the second organic light-emitting diode, and a cathode of the second organic light-emitting diode is electrically connected to the voltage output end of the second power supply;

a first end of the second storage capacitor is electrically connected to the control end of the second driving transistor, and a second end of the second storage capacitor is electrically connected to the second end of the second driving transistor; and a second end of the fourth transistor is electrically connected to the second end of the second driving transistor.

7. The display panel according to claim 6, wherein:

when the reference voltage signal line corresponding to the nth pixel driving circuit is multiplexed as the data signal line corresponding to the (n+1)th pixel driving circuit, a first end of the third transistor is electrically connected to the nth reference voltage signal line, and a first end of the fourth transistor is electrically connected to the (n+1)th reference voltage signal line;

control ends of the first transistors and control ends of the second transistors in the odd-numbered pixel driving circuits are electrically connected to a first scanning line, and control ends of the third transistors and control ends of the fourth transistors in the even-numbered pixel driving circuits are electrically connected to a second scanning line.

8. The display panel according to claim 7, wherein:

a first electrode of the first transistor is electrically connected to the nth data signal line, and a second electrode of the first transistor is electrically connected to a gate electrode of the first driving transistor;

a drain electrode of the first driving transistor is electrically connected to the voltage output end of the first power supply, the gate electrode of the first driving transistor is electrically connected to a first polar plate of the first capacitor, a source electrode of the first driving transistor is electrically connected to a second polar plate of the first capacitor and the anode of the first organic light-emitting diode;

a first electrode of the second transistor is electrically connected to the nth reference voltage signal line, and a second electrode of the second transistor is electrically connected to a source electrode of the second driving transistor;

a second electrode of the third transistor is electrically connected to a gate electrode of the second driving transistor, a drain electrode of the second driving transistor is electrically connected to the voltage output end of the first power supply, the gate electrode of the second driving transistor is electrically connected to a first polar plate of the second capacitor, the source electrode of the second driving transistor is electrically connected to a second polar plate of the second capacitor and the anode of the second organic light-emitting diode, and a second electrode of the fourth transistor is electrically connected to the source electrode of the second driving transistor; and the cathode of the first organic light-emitting diode and the cathode of the second light-emitting diode are electrically connected to the voltage output end of the second power supply, respectively.

9. The display panel according to claim 8, wherein:

a first electrode of the third transistor is electrically connected to the nth reference voltage signal line, and a first electrode of the fourth transistor is electrically connected to the (n+1)th reference voltage signal line.

10. The display panel according to claim 9, wherein:

the first driving transistor, the second driving transistor, the first transistor, the second transistor, the third transistor, and the fourth transistor are all N-type transistors.

11. A threshold detection method used in a display panel, wherein the display panel includes a plurality of data signal lines configured to transmit data signals, a plurality of scanning lines configured to transmit driving signals, and mutually insulated from the plurality of data signal lines, a plurality of reference voltage signal lines configured to transmit reference voltage signals, a plurality of pixels enclosed and defined by the mutually insulated plurality of data signal lines and plurality of scanning lines, and a plurality of pixel driving circuits (1st, 2nd, . . . , nth, (n+1)th, . . . ) individually disposed in each pixel of the plurality of pixels, each pixel driving circuit corresponds to one data signal line and one reference voltage signal line, and when a same signal line is used as a reference voltage signal line RL(n), corresponding to an nth pixel driving circuit, and as a data signal line DL(n+1), corresponding to an (n+1)th pixel driving circuit, the same signal line is used to time-sharingly output a reference voltage signal to the nth pixel driving circuit and output a data signal to the (n+1)th pixel driving circuit, where n is a positive integer, the method comprising:

when the reference voltage signal line corresponding to the nth pixel driving circuit is multiplexed as the data signal line corresponding to the (n+1)th pixel driving circuit, outputting a reference voltage signal by the reference voltage signal line corresponding to the nth pixel driving circuit during a threshold detection stage of the nth pixel driving circuit, and outputting a data signal by the reference voltage signal line corresponding to the nth pixel driving circuit during a threshold detection stage of the (n+1)th pixel driving circuit.

12. The method according to claim 11, wherein:

when the same signal line is used as the reference voltage signal line RL(n) and as the data signal line DL(n+1) corresponding to the (n+1)th pixel driving circuit, a first pixel driving circuit has an independent data signal line, and a last pixel driving circuit has an independent reference voltage signal line.

13. The method according to claim 11, wherein:

each column of the pixel driving circuits share a same data signal line and a same reference voltage signal line.

14. The method according to claim 11, wherein:

in each row of the pixel driving circuits, odd-numbered pixel driving circuits share the same scanning line, and even-numbered pixel driving circuits share the same scanning line.

15. The method according to claim 11, wherein:

a threshold detection stage is carried out in any pixel driving circuit during each display frame.

16. The method according to claim 11, wherein:

fulfilling the threshold detection stages for all pixel driving circuits in a pre-determined time period before display.

17. The method according to claim 11, wherein:

the nth pixel driving circuit further includes a first driving transistor, a first storage capacitor, and a first organic light-emitting diode; and the (n+1)th pixel driving circuit further includes a second driving transistor, a second storage capacitor, and a second organic light-emitting diode.

18. The method according to claim 17, wherein:

a first end of the first transistor is electrically connected to an nth data signal line, and a second end of the first transistor is electrically connected to a control end of the first driving transistor;

a first end of the first driving transistor is electrically connected to a voltage output end of a first power supply, a second end of the first driving transistor is electrically connected to an anode of the first organic light-emitting diode, and a cathode of the first organic light-emitting diode is electrically connected to a voltage output end of a second power supply;

a first end of the first storage capacitor is electrically connected to the control end of the first driving transistor, and a second end of the first storage transistor is electrically connected to the second end of the first driving transistor;

a first end of the second transistor is electrically connected to the nth reference voltage signal line, and a second end of the second transistor is electrically connected to the second end of the first driving transistor;

a second end of the third transistor is electrically connected to a control end of the second driving transistor;

a first end of the second driving transistor is electrically connected to the voltage output end of the first power supply, a second end of the second driving transistor is electrically connected to an anode of the second organic light-emitting diode, and a cathode of the second organic light-emitting diode is electrically connected to the voltage output end of the second power supply;

a first end of the second storage capacitor is electrically connected to the control end of the second driving transistor, and a second end of the second storage capacitor is electrically connected to the second end of the second driving transistor; and a second end of the fourth transistor is electrically connected to the second end of the second driving transistor.

19. The method according to claim 18, wherein:

when the reference voltage signal line corresponding to the nth pixel driving circuit is multiplexed as the data signal line corresponding to the (n+1)th pixel driving circuit, a first end of the third transistor is electrically connected to the nth reference voltage signal line, and a first end of the fourth transistor is electrically connected to the (n+1)th reference voltage signal line;

control ends of the first transistors and control ends of the second transistors in the odd-numbered pixel driving circuits are electrically connected to a first scanning line, and control ends of the third transistors and control ends of the fourth transistors in the even-numbered pixel driving circuits are electrically connected to a second scanning line.

20. The method according to claim 19, wherein:

a first electrode of the first transistor is electrically connected to the nth data signal line, and a second electrode of the first transistor is electrically connected to a gate electrode of the first driving transistor;

a drain electrode of the first driving transistor is electrically connected to the voltage output end of the first power supply, the gate electrode of the first driving transistor is electrically connected to a first polar plate of the first capacitor, a source electrode of the first driving transistor is electrically connected to a second polar plate of the first capacitor and the anode of the first organic light-emitting diode;

a first electrode of the second transistor is electrically connected to the nth reference voltage signal line, and a second electrode of the second transistor is electrically connected to a source electrode of the second driving transistor;

a second electrode of the third transistor is electrically connected to a gate electrode of the second driving transistor, a drain electrode of the second driving transistor is electrically connected to the voltage output end of the first power supply, the gate electrode of the second driving transistor is electrically connected to a first polar plate of the second capacitor, the source electrode of the second driving transistor is electrically connected to a second polar plate of the second capacitor and the anode of the second organic light-emitting diode, and a second electrode of the fourth transistor is electrically connected to the source electrode of the second driving transistor; and the cathode of the first organic light-emitting diode and the cathode of the second light-emitting diode are electrically connected to the voltage output end of the second power supply, respectively.

* * * * *